US010145059B2

(12) United States Patent
Kim

(10) Patent No.: US 10,145,059 B2
(45) Date of Patent: Dec. 4, 2018

(54) CLOTHES TREATING APPARATUS

(71) Applicant: LG Electronics Inc., Seoul (KR)

(72) Inventor: Junhong Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/609,558

(22) Filed: May 31, 2017

(65) Prior Publication Data

US 2017/0350066 A1 Dec. 7, 2017

(30) Foreign Application Priority Data

Jun. 3, 2016 (KR) ..... 10-2016-0069741

(51) Int. Cl.

| | |
|---|---|
| ***D06F 58/10*** | (2006.01) |
| ***D06F 58/20*** | (2006.01) |
| ***D06F 58/28*** | (2006.01) |
| ***D06F 73/02*** | (2006.01) |

(52) U.S. Cl.

CPC ..... *D06F 73/02* (2013.01); *D06F 58/10* (2013.01); *D06F 58/203* (2013.01); *D06F 58/28* (2013.01); *D06F 2058/2861* (2013.01)

(58) Field of Classification Search

CPC ..... D06F 58/10; D06F 58/28; D06F 58/203; D06F 73/02; D06F 2058/2861

USPC ..... 68/5 B, 5 C, 5 R, 12.02, 12.03, 12.15, 68/12.16, 12.23, 12.27, 20

See application file for complete search history.

(56) References Cited

U.S. PATENT DOCUMENTS

| | | | | |
|---|---|---|---|---|
| 2008/0155757 | A1 | 7/2008 | Kim et al. | |
| 2009/0235464 | A1* | 9/2009 | Cassidy | D06F 17/04 8/137 |
| 2010/0180645 | A1* | 7/2010 | Kim | D06F 58/12 68/5 C |

FOREIGN PATENT DOCUMENTS

| | | | |
|---|---|---|---|
| DE | 102013219700 | A1 | 4/2015 |
| JP | H05207957 | A | 8/1993 |
| JP | 3063149 | B2 | 7/2000 |
| WO | 2011126318 | A2 | 10/2011 |

* cited by examiner

*Primary Examiner* — Levon J Shahinian
(74) *Attorney, Agent, or Firm* — Dentons US LLP

(57) ABSTRACT

The present invention relates to a clothes treating apparatus, including a door to open/close an accommodation space, a hanger provided in the accommodation space and having at least one clothes caught thereon, a sensing unit to sense information related to the clothes caught on the hanger, a controller to control an operation of the clothes treating apparatus based on the sensed information, and an input unit to receive a user input associated with the operation, wherein the controller determines whether a user input is applied to the input unit while a predetermined time interval elapses from a time point that the door has been opened and then closed, determines whether clothes have been added into the accommodation space when a user input is not applied during the lapse of the predetermined time interval, and performs a preset operation of the clothes treating apparatus when it is determined that the clothes have been added to the accommodation space.

13 Claims, 7 Drawing Sheets

CLOTHES TREATING APPARATUS

CROSS-REFERENCE TO RELATED APPLICATION

Pursuant to 35 U.S.C. § 119(a), this application claims the benefit of an earlier filing date of and the right of priority to Korean Application No. 10-2016-0069741, filed on Jun. 3, 2016, the contents of which are incorporated by reference herein in its entirety.

BACKGROUND OF THE INVENTION

1. Field of the Invention

The present invention relates to a clothes treating apparatus capable of removing wrinkles of clothes.

2. Background of the Invention

In recent years, various kinds of clothes treating apparatuses have been used together with washing machines for washing clothes. For example, there have been developed drum type driers for drying clothes that have been completely washed, cabinet type dryers for drying clothes while the clothes are hung, refreshers for refreshing clothes by supplying hot air to the clothes, and the like.

Among those clothes treating apparatuses, the dryer, the refresher and the like mainly supply hot air heated by a heater to clothes. Examples of the heater include a gas heater which heats air by burning gas, an electric heater which heats air by electric resistance, and the like. Recently, the electric heater which is easy to be installed and has a simple structure is widely used.

In recent years, clothes treating apparatuses which supply steam for removing wrinkles as well as supplying hot air to clothes stored therein have also been developed. Such developed clothes treating apparatuses mainly use a method of fixing clothes by pulling them to apply tension to the clothes and supplying steam to remove wrinkles of the clothes.

On the other hand, the clothes treating apparatus performs a function of managing clothes by supplying steam or hot air, as described above, and simultaneously performs a function of storing the clothes. Therefore, when bad smell is absorbed in clothes newly introduced into the clothes treating apparatus, clothes previously stored in the clothes treating apparatus may be contaminated due to the bad smell.

In addition, even if a user of the clothes treating apparatus stores contaminated clothes in the clothes treating apparatus but does not perform any operation, even clothes stored in advance in the clothes treating apparatus may be contaminated.

Therefore, a clothes treating apparatus capable of appropriately treating clothes stored therein even when any input is not applied by a user of the clothes treating apparatus is required.

SUMMARY OF THE INVENTION

Therefore, an aspect of the present invention is to provide a clothes treating apparatus capable of effectively removing contamination of clothes stored in the clothes treating apparatus or maintaining hygiene of the stored clothes, even when any input is not applied by a user of the clothes treating apparatus.

Specifically, an aspect of the present invention is to provide a clothes treating apparatus capable of preventing contamination between clothes which are currently stored in the clothes treating apparatus, by recognizing an entrance/exit of clothes to be stored.

Another object of the present invention is to provide a clothes treating apparatus capable of appropriately managing introduced clothes even though a user input is not applied when new clothes are introduced into the clothes treating apparatus.

To achieve these and other advantages and in accordance with the purpose of this specification, as embodied and broadly described herein, there is provided a clothes treating apparatus, including a door to open and close an accommodation space of the clothes treating apparatus, a hanger provided in the accommodation space and having at least one clothes caught thereon, a sensing unit to sense information related to the clothes caught on the hanger, a controller to control an operation of the clothes treating apparatus based on the sensed information, and an input unit to receive a user input associated with the operation of the clothes treating apparatus. The controller may determine whether a user input is applied to the input unit while a predetermined time interval elapses from a time point that the door has been opened and then closed, determine whether clothes have been added into the accommodation space when a user input is not applied during the lapse of the predetermined time interval, and perform a preset operation of the clothes treating apparatus when it is determined that the clothes have been added to the accommodation space.

In accordance with one embodiment disclosed herein, the hanger may include a motor to supply power for applying a predetermined motion to clothes caught on the hanger, and the controller may drive the motor when the door is opened and then closed.

In accordance with one embodiment disclosed herein, the controller may drive the motor for a preset time interval when the door is opened and then closed, detect information related to a weight of the clothes caught on the hanger based on a power value consumed by the motor while the motor is driven, and determine whether or not the clothes have been added into the accommodation space based on the detected weight.

In accordance with one embodiment disclosed herein, the sensing unit may include a weight sensor to sense a weight of clothes caught on the hanger, and the controller may determine whether or not clothes have been added into the accommodation space based on a sensing value of the weight sensor when the door is opened and then closed.

In accordance with one embodiment disclosed herein, the sensing unit may include an optical sensor provided with a light emitting portion and a light receiving portion, and the controller may determine whether or not clothes have been added into the accommodation space based on a sensing value of the optical sensor when the door is opened and then closed.

In accordance with one embodiment disclosed herein, the preset operation of the clothes treating apparatus may be to emit steam into the accommodation space for a preset time interval.

In accordance with one embodiment disclosed herein, the preset operation of the clothes treating apparatus may be to supply heated air into the accommodation space for a predetermined time interval.

In accordance with one embodiment disclosed herein, the preset operation of the clothes treating apparatus may be to vibrate the hanger for a predetermined time interval.

In accordance with one embodiment disclosed herein, the preset operation of the clothes treating apparatus may be to perform at least one of a process of emitting the steam, a process of supplying the heated air and a process of vibrating the hanger, in an arbitrary sequence.

In accordance with one embodiment disclosed herein, the controller may perform the operation of the clothes treating apparatus based on the applied user input, when the user input associated with the operation of the clothes treating apparatus is applied to the input unit before the predetermined time interval elapses from the time point that the door has been opened and then closed.

In accordance with one embodiment disclosed herein, the controller may stop the preset operation and perform the operation of the clothes treating apparatus based on the applied user input when the user input associated with the operation of the clothes treating apparatus is applied to the input unit while the preset operation of the clothes treating apparatus is performed.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Figure 1A:
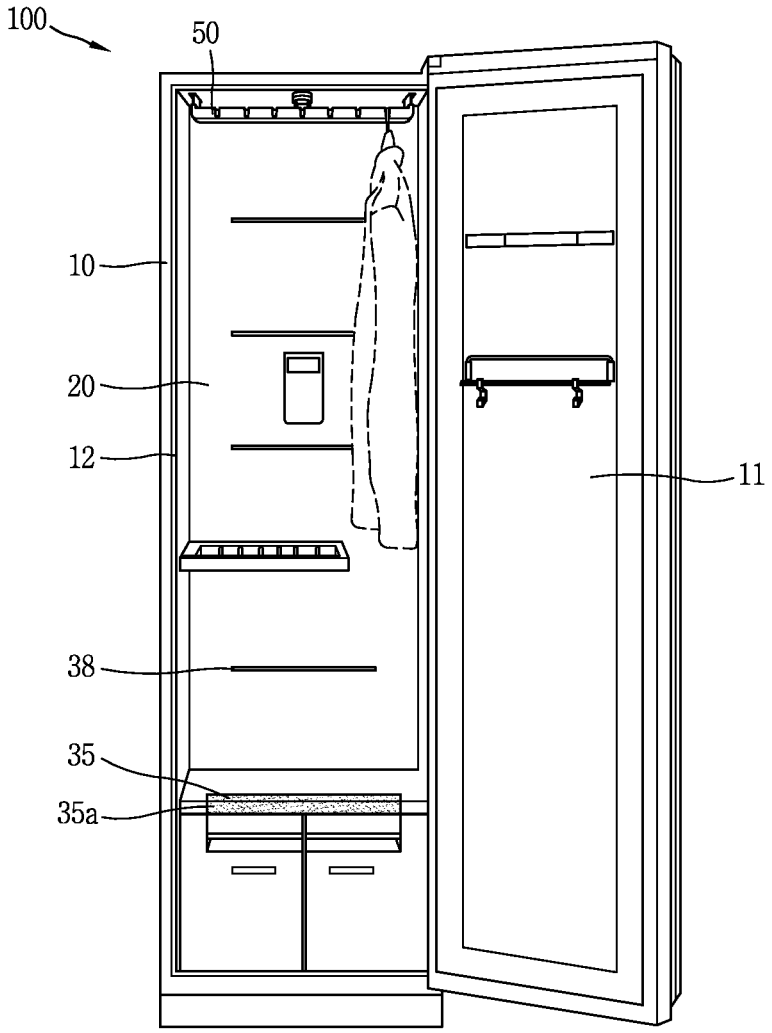
FIGS. 1A and 1B are conceptual views of a clothes treating apparatus in accordance with one embodiment of the present invention.

Description will now be given in detail of exemplary embodiments disclosed herein, with reference to the accompanying drawings.

In describing the present invention, if a detailed explanation for a related known function or construction is considered to unnecessarily divert the gist of the present disclosure, such explanation has been omitted but would be understood by those skilled in the art.

The accompanying drawings are used to help easily understood the technical idea of the present invention and it should be understood that the idea of the present disclosure is not limited by the accompanying drawings. As such, the present disclosure should be construed to extend to any alterations, equivalents and substitutes in addition to those which are particularly set out in the accompanying drawings.

FIG. 1 is a conceptual view of a clothes treating apparatus 100 according to one embodiment of the present invention.

First, the cabinet 10 forms an outer appearance of the clothes treating apparatus according to the present invention, and is provided with an accommodation space 20 formed therein for accommodating clothes (clothing) to be treated.

As illustrated in FIG. 1, the accommodation space 20 is actually formed by an inner cabinet 12, which is provided separately within the cabinet 10. The inner cabinet 12 is fixed to the cabinet 10 and thus remains stationary. The accommodation space 20 as well as the inner cabinet 20 is not moved. The accommodation space 20 and the inner cabinet 12 may be disposed at an upper portion of the cabinet 10 and a front portion of the accommodation space 20 is opened.

That is, the accommodation space 20 has an inlet formed in the front portion thereof, and thus a user can easily put the clothes into the accommodation space 20 through the inlet. The accommodation space 20 may selectively be opened or closed by a door 11 which is rotatably installed on the cabinet 10.

Various switches (not illustrated) for operating the clothes treating apparatus may be provided on an outer surface of the door 11 or the cabinet 10.

Figure 1B:
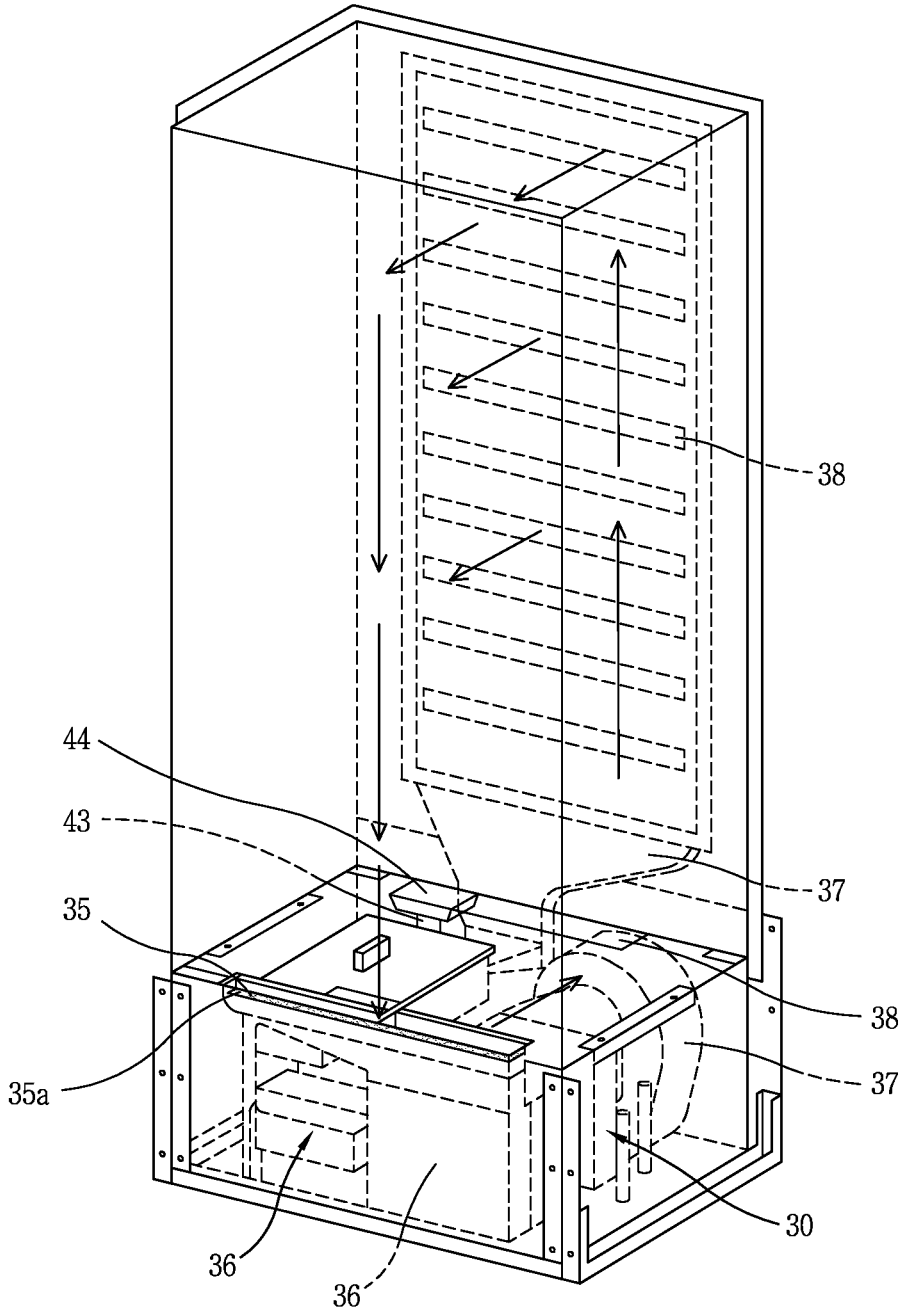

Referring to FIG. 1B, an outfit chamber having a predetermined size is formed below the accommodation space 20, and an air supply device 30 is installed in the outfit chamber. The air supply device 30 basically removes moisture from air and provides dry air into the accommodation space 20 for drying clothes.

In addition, the air supply device 30 may heat the air to supply hot and dry air. Since hot air generally rises in an upward direction, it is advantageous that the air supply device 30 is installed at a lower portion of the cabinet 10, namely, below the accommodation space 20 in view of supplying hot and dry air. The air supply device 30 is preferably separated from the accommodation space 20 by a separate barrier wall. A top wall of the outfit chamber or a bottom wall of the inner cabinet 12 may be actually the barrier wall. The barrier wall may prevent the clothes from being damaged by the high-temperature air supply device 30 and prevent condensed water generated in the air supply device 30 from being soaked in the clothes.

The air supply device 30 may include a heater or a thermoelement for producing hot air and a dehumidifier provided separately from such heater. However, it is preferable to use a heat pump which is capable of simultaneously performing dehumidification and air heating.

Therefore, the clothes treating apparatus uses a heat pump as the air supply device 30. The air supply device 30 is provided with an evaporator, a compressor, a condenser, and an expansion valve (not shown) through which refrigerant is circulated. In this case, while refrigerant is evaporated in the evaporator, the refrigerant absorbs latent heat of ambient air and cools the air. By cooling the air, moisture in the air can be condensed and thus removed. Further, when the refrigerant is condensed in the condenser after being compressed in the compressor, the refrigerant heats ambient air by releasing latent heat toward the ambient air. Accordingly, the evaporator and the condenser serve as a heat exchanger, and thus air introduced into the air supply device 30 becomes dry and hot while passing through the evaporator and the condenser.

Thus, the clothes treating apparatus using the heat pump can be dehumidified without using a separate dehumidifier. Therefore, air generated in the air supply device 30 can effectively dry the clothes within the accommodation space 20, such that the clothes can be refreshed into a suitable state to be worn.

As illustrated in FIG. 1B, the accommodation space 20 is provided with a suction port 35 through which air within the accommodation space 20 is introduced into the air supply device 30. The introduced air is heated and dehumidified in the air supply device 30, i.e., the evaporator and the condenser. In addition, the accommodation space 20 is provided with a discharge port 38 through which dry and hot air from the air supply device 30 is supplied into the accommodation space 20. Therefore, the clothes treating apparatus can have a circulation flow path of the dry air generated by the air supply device 30.

This specification will describe a refresher, which refreshes clothes and supplies hot air, as a clothes treating apparatus. However, the present invention is not limited to this and may alternatively be applied to other devices which may include a heat pump to be described later. Here, refreshing may refer to supplying air, heated air, water, mist, steam, etc. to clothes to remove wrinkles of the clothes, deodorize the clothes, sanitize the clothes, prevent static electricity, warm the clothes and the like. In addition, clothes disclosed in this specification include not only clothing and apparel, but also objects such as shoes, socks, gloves, hats, shawls, etc. which can be worn by a user, and objects such as dolls, towels, bedclothes, etc. which can be used by the user, namely, every object that can be washed.

The cabinet 10 is provided with various components to be described later and includes the accommodation space 20 in which clothes are accommodated. The accommodation space 20 selectively communicates with outside by the door 11. In addition, the accommodation space 20 is provided with various types of supports (or supporting rods) (not illustrated) for hanging clothes. The supports may be provided to keep the clothes stationary or fixed without movement. On the other hand, the supports may be configured, as described later, to apply a predetermined motion to the clothes when air, hot air, moisture, mist, steam, or the like is supplied.

That is, referring to FIG. 1A, the clothes are caught on a moving hanger 50 provided in the accommodation space 20. The moving hanger (50) is configured to apply a predetermined motion to the clothes. If the predetermined motion is applied while air, hot air, moisture, mist, steam, or the like is supplied to the clothes, the refreshing effect of the clothes is increased.

Figure 1C:
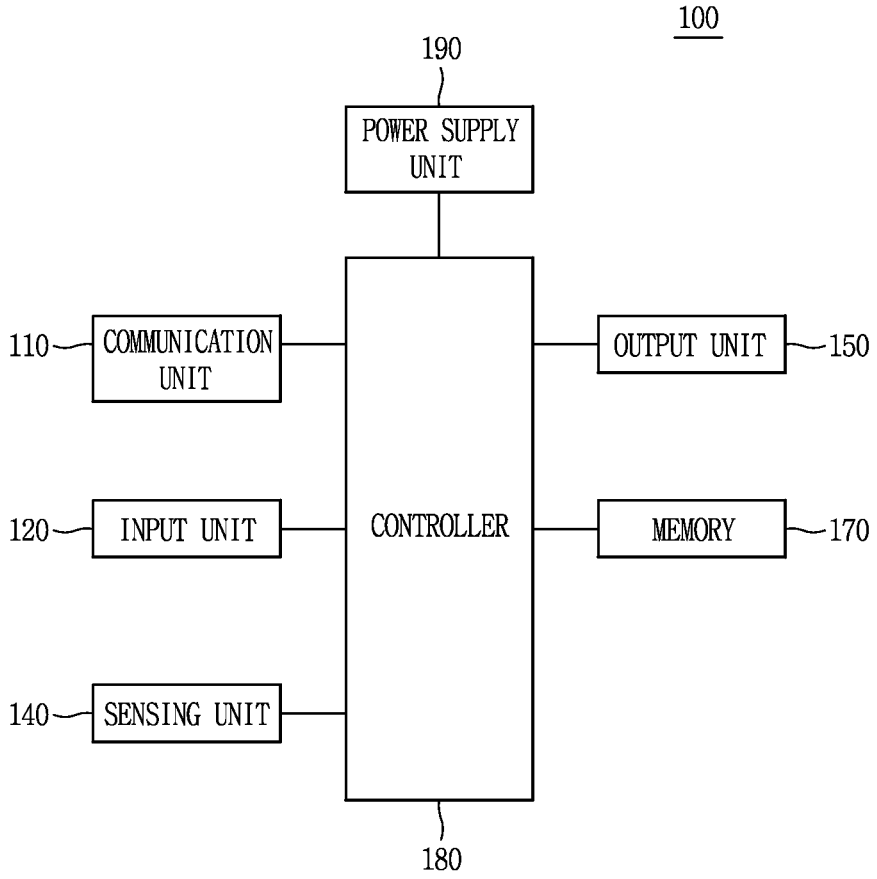
FIG. 1C is a block diagram of a clothes treating apparatus in accordance with one embodiment of the present invention.

Referring to FIG. 1C, the clothes treating apparatus 100 includes at least one of a communication unit 110, an input unit 120, a sensing unit 140, an output unit 150, a memory 170, a controller 180, and a power supply unit 190.

The communication unit 110 may include at least one component for performing wired/wireless communication between the clothes treating apparatus 100 and a wired/wireless communication system or between the clothes treating apparatus 100 and a network in which the clothes treating apparatus 100 is located. For example, the communication unit 110 may include a broadcast receiving module, a wireless Internet module, a short-range communication module, a location information module, and the like.

The wireless Internet module included in the communication unit 110 refers to a module for performing a wireless Internet access, and may be disposed internally or externally at the clothes treating apparatus 100. Here, examples of wireless Internet technologies may include a wireless LAN (WLAN), wireless fidelity (Wi-Fi), Wibro, WiMAX, high speed downlink packet access (HSDPA), and the like.

The short-range communication module included in the communication unit 110 refers to a module for performing short-range communication. Examples of short-range communication technologies may include Bluetooth, radio frequency identification (RFID), infrared data association (IrDA), ultra wideband (UWB), ZigBee, etc.

The location information module included in the communication unit 110 is a module for confirming or obtaining a location (position) of the clothes treating apparatus. One example is a global position system (GPS) module. The GPS module receives location information from a plurality of satellites. Here, the location information may include coordinate information indicated by latitude and longitude. For example, the GPS module may measure an accurate time and distance from three or more satellites, and accurately calculate a current location of the mobile terminal according to trigonometry based on the measured three different distances. A method of obtaining distance and time information from three satellites and correcting an error with one satellite may be used. In particular, the GPS module may acquire three-dimensional velocity information and accurate time as well as the location of latitude, longitude and altitude, from the location information received from the satellites.

The communication unit 110 may receive data from a user and transmit information processed by the controller 180 of the clothes treating apparatus 100 and information sensed by the sensing unit 140 to an external terminal (not illustrated).

The sensing unit 140 may sense internal or external temperature of a storage chamber of the clothes treating apparatus, opening of the door of the clothes treating apparatus, and the like.

More specifically, the sensing unit 140 may include a sensor for sensing temperature of at least one of an inlet of the evaporator and an outlet of the evaporator.

The sensing unit 140 may include at least one sensor attached to one surface of the interior of the clothes treating apparatus, and at least one sensor attached to one of outer wall surfaces of the clothes treating apparatus to sense temperature of external air. In addition, the sensing unit 140 may include a sensor for sensing whether the compressor is driven, and a value of a cooling capacity of the compressor. Information sensed by the sensing unit 140 may be transmitted to the controller 180.

The input unit 120 is to receive a user input for the operation of the clothes treating apparatus 100 or confirming the state of the clothes treating apparatus 100 so as to output a signal corresponding to the user input. The input unit 120 may be implemented in a form of a button or a touch pad.

More specifically, the input unit 120 may be implemented in a form of a touch screen on a display of the output unit 150 of the clothes treating apparatus. Also, the input unit 120 may further include a camera module for capturing an image of clothes to be stored in the clothes treating apparatus, or an image of a bar code or a QR code attached to the clothes. In addition, the input unit 120 may further include a microphone for inputting audio such as a user's voice.

The memory 170 may store information related to the clothes treating apparatus 100, for example, a program for driving the clothes treating apparatus 100, information set for driving the clothes treating apparatus, a clothes treating apparatus application, status information related to the clothing treating apparatus, information related to clothes stored in the clothes treating apparatus, user information, multimedia contents, and the like, and may also include icons or graphic data for visually expressing such information.

The memory 170 may store at least one of location information related to an installed place of the clothes treating apparatus 100, information related to at least one terminal to collect a location, and connection information related to a server (not illustrated).

The output unit 150 is to display information related to the clothes treating apparatus in a visual or audible manner, and may include a flat display and a speaker. Specifically, the display may be configured as a touch panel receiving a user's touch input.

The display of the output unit 150 displays a User Interface (UI) or a Graphic User Interface (GUI) associated with driving of the clothes treating apparatus. More specifically, the display may include at least one of a liquid crystal display, a thin film transistor liquid crystal display, an organic light emitting diode, a flexible display, and a 3D display. Two or more displays may be provided depending on the implementation of the clothes treating apparatus 100. For example, a first display and a second display may be provided at different positions on one surface of the door of the clothes treating apparatus 100.

When the display and a sensor (hereinafter, referred to as 'touch sensor') for sensing a touch operation are interlayered (hereinafter, referred to as 'touch screen'), the display may also be used as an input device as well as an output device. The touch sensor may be configured in a form of, for example, a touch film, a touch sheet, a touch pad, or the like.

The power supply unit 190 receives external and internal power under the control of the controller 180 and supplies power necessary for operations of respective components.

The operation of the controller 180 or an operation of an application executed by the operation of the controller 180 is based on a premise of an intermediary operation of an operating system, and description of the intermediary operation will be omitted.

In addition to the operations associated with the application program, the controller 180 typically controls the overall operation of the clothes treating apparatus 100. The controller 180 may provide or process information or functions assorted to a user by processing signals, data, information, and the like input or output through the components described above or by operating an application program stored in the memory 170.

Hereinafter, one embodiment related to a moving hanger will be described with reference to FIGS. 2A and 2B.

Figure 2A:
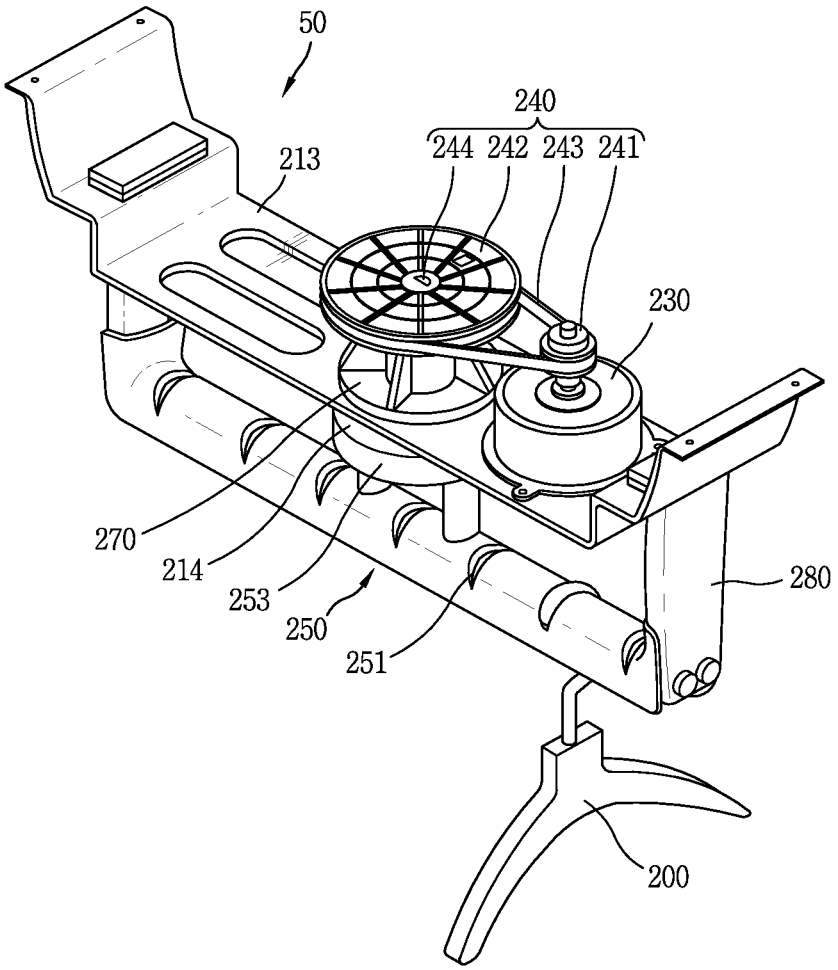
FIGS. 2A and 2B are conceptual views illustrating one embodiment related to a moving hanger of FIG. 1A.

Referring to FIG. 2A, a moving hanger 50 includes a hanger bar 250 for supporting clothes caught on a coat hanger 200, and supporting parts 280 for supporting both ends of the hanger bar 250. The hanger bar 250 is provided with a plurality of hanger grooves (251) each for fixing a position of the coat hanger 200 when the coat hanger 200 is mounted. The supporting parts 280 are connected to a moving hanger frame 213 and the moving hanger frame 213 is provided on a ceiling within the cabinet 10 so as to be invisible from outside. Supporting ribs 254 are provided on both ends of the hanger bar 250 so as to surround end portions of the supporting parts 280, respectively.

Therefore, the clothes treating apparatus according to the present invention can expect a superior effect in drying efficiency of clothes as well as a refreshing effect, compared to the related art clothes treating apparatus, because the clothes stored in the clothes treating apparatus are caught on the coat hangers.

On the other hand, the moving hanger 50 includes a motor 230, a power conversion unit (not illustrated) for converting a rotational motion provided by the motor 230 into a horizontal linear motion of the hanger bar 250, and a power transmission unit 240 for transmitting power supplied by the motor 230 to the power conversion unit.

The power transmission unit 240 includes a driving pulley 241 provided on the motor 230, a driven pulley 242 connected to the driving pulley 241 by a belt 243, and a rotating shaft 244 coupled to a center of the driven pulley 244. The rotating shaft 244 is rotatably provided within a bearing housing 270 provided on the moving hanger frame 213.

Preferably, the hanger bar 250 further includes a slot (not illustrated) orthogonal to a longitudinal direction thereof. Specifically, the hanger bar 250 is provided with a slot housing 253 at an upper portion thereof, and the slot at an approximately central portion of the slot housing 253. The power conversion unit includes a slot insertion portion inserted into the slot, an axial coupling portion coupled to the rotating shaft 244, and a rotary arm connecting the slot insertion portion and the axial coupling portion. The power conversion unit is enclosed by a cover 214 so as to be invisible from the outside, and the cover 214 is provided between the moving hanger frame 213 and the slot housing 253.

With the configuration, when the motor 230 rotates, the driven pulley 242 is rotated. Accordingly, the rotating shaft 244 coupled to the driven pulley 242 is also rotated, and the slot insertion portion performs a circular motion with a predetermined diameter.

The slot provided at the hanger bar 250 is formed to be orthogonal to the longitudinal direction of the hanger bar 250 and also has a length longer than a diameter of a rotation locus of the slot insertion portion. Therefore, the slot may perform a linear motion in a horizontal direction even if the slot insertion portion performs the circular motion. Thus, the hanger bar 250 coupled to the slot is subject to a horizontal linear motion.

Figure 2B:
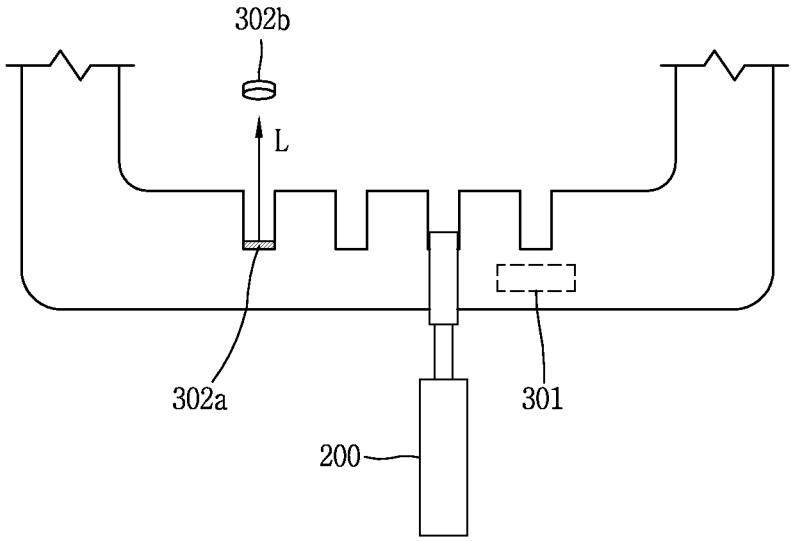

Referring to FIG. 2B, a plurality of sensors are provided in portions of the moving hanger 50 to determine whether or not new clothes are caught on the moving hanger 50.

As illustrated in FIG. 2B, the moving hanger 50 may include a plurality of sensors for determining whether or not new clothes are caught on the moving hanger 50.

Specifically, the moving hanger 50 may be provided with a weight sensor 301 for determining whether or not new clothes are caught on the moving hanger 50. In one embodiment, the moving hanger 50 may include a plurality of weight sensors 301 corresponding to the plurality of hanger grooves 251, respectively.

As illustrated in FIG. 2B, the weight sensor 301 may be installed inside the hanger bar 250. In particular, the weight sensor 301 may be installed at a position, on which the hanger groove 251 is formed, within the hanger bar 250. Thus, when the coat hanger 200 with clothes caught is hung on the hanger groove 251, the weight sensor 301 may sense weights of the coat hanger 200 and the clothes. The controller 180 may detect that the new clothes are caught on the moving hanger 50 based on the sensing value sensed by the weight sensor 301.

For example, when the sensing value sensed by the weight sensor 301 corresponds to a weight of the coat hanger 200, the controller 180 may determine that only the coat hanger 200 is hung on the moving hanger 50.

In another example, when the sensing value sensed by the weight sensor 301 is greater than the weight of the coat hanger 200 by a predetermined weight value or more, the controller 180 may determine that the coat hanger 200 with clothes caught is hung on the moving hanger 50.

In another example, when the sensed value sensed by the weight sensor 301 changes by a predetermined weight value or more within a preset time interval, the controller 180 may determine that the coat hanger 200 with newly-stored clothes caught thereon is hung on the moving hanger 50.

In another example, when the sensed value sensed by the weight sensor 301 increases by a predetermined weight value or more within a preset time interval, the controller 180 may determine that the coat hanger 200 with newly-stored clothes caught thereon is hung on the moving hanger 50.

In another example, when the sensed value sensed by the weight sensor 301 is reduced and a sensing value sensed after the reduction is more than a reference weight value, the controller 180 may determine that the coat hanger 200 with newly-stored clothes caught thereon is hung on the moving hanger 50.

Also, referring to FIG. 2B, an optical sensor 302 may be installed at a portion of the hanger bar 250. In particular, the optical sensor 302 may be installed on a bottom of the hanger groove 251 and may emit preset light toward the ceiling of the clothes treating apparatus 100. A light receiving portion corresponding to the optical sensor 302 may be installed in the ceiling of the clothes treating apparatus 100.

Thus, while the light receiving portion receives light emitted from the optical sensor 302, when the light is blocked for a predetermined time or more, the controller 180 may determine that new clothes are stored on the moving hanger 50.

In one embodiment, the moving hanger 50 may include a plurality of optical sensors 302 corresponding to the plurality of hanger grooves 251, respectively. Further, the light receiving portions corresponding to the plurality of optical sensors 302 may be provided in the ceiling of the clothes treating apparatus 100. In this case, if no light is received in any one of the light receiving portions for a predetermined time or more and a light reception state of another light receiving portion is not changed, the controller 180 may determine that new clothes are caught on the moving hanger 50. Here, the light reception state of the light receiving portion may be divided into a state of receiving light and a state of not receiving light.

On the other hand, the controller 180 may determine whether or not clothes are added into the clothes treating apparatus 100 by using a camera module installed inside the clothes treating apparatus 100.

In another embodiment, the controller 180 may drive the motor 230 of the moving hanger 50 when it is determined that the door of the clothes treating apparatus 100 is opened and then closed. The controller 180 may also detect a power value consumed by the motor 230 while the motor 230 is driven and calculate a weight of clothes caught on the moving hanger 50 based on the detected power value. Thus, when it is determined that the weight of the clothes caught on the moving hanger 50 has changed or increased as compared with the weight sensed before the door is opened and closed, the controller 180 may determine that new clothes to be stored in the clothes treating apparatus 100 are added.

Figure 3:
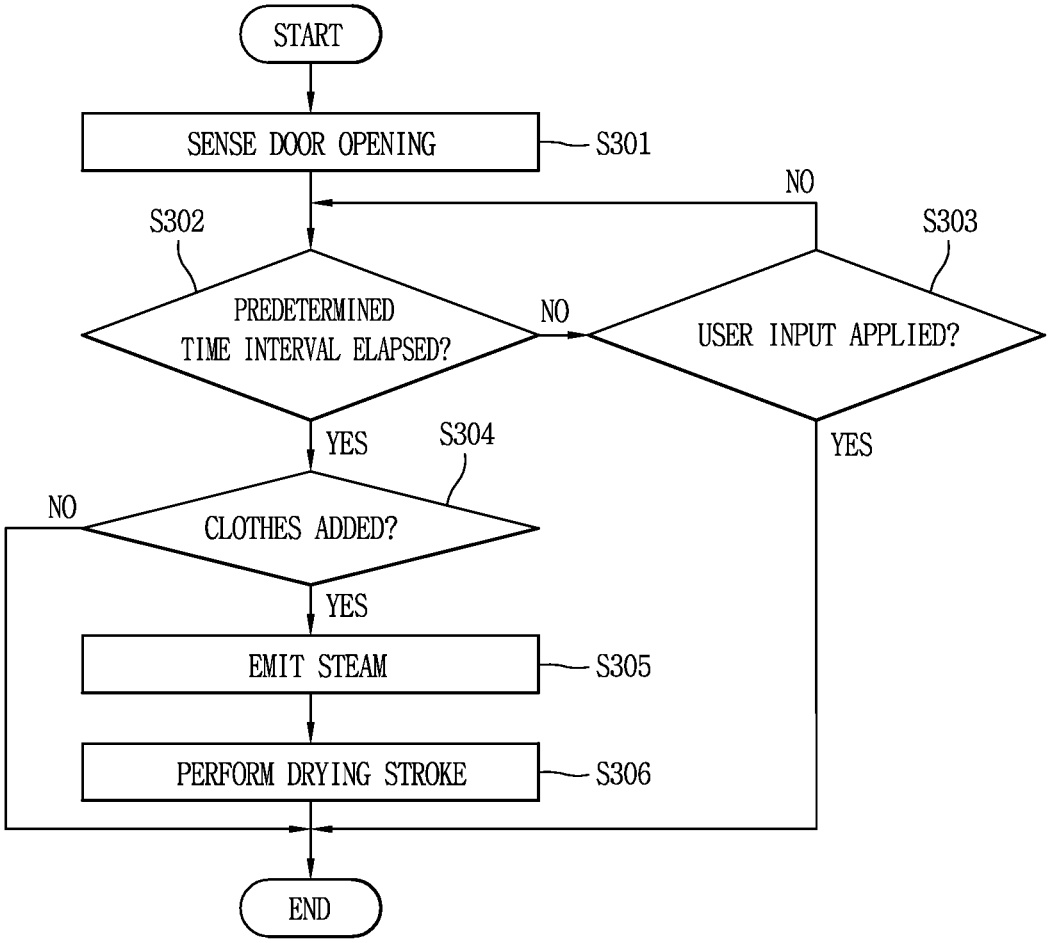
FIG. 3 is a flowchart illustrating a method for controlling a clothes treating apparatus in accordance with the present invention.

In FIG. 3, the controller 180 may detect whether the door is opened or closed (S301). The controller 180 may detect whether the door is opened or closed based on a sensor installed in a hinge (not illustrated) of the door.

The controller 180 may determine whether a predetermined time interval has elapsed since the door was opened or closed (S302).

Before the predetermined time interval elapses, the controller 180 may determine whether a predetermined user input is applied (S303).

Specifically, the controller 180 may determine whether a predetermined time interval elapses from a time point that the door is opened and then closed, and determine whether or not the user input is applied to the input unit during the elapse of the predetermined time interval.

For example, the predetermined user input may include a user input associated with the operation of the clothes treating apparatus 100.

When the predetermined time interval elapses, the controller 180 may determine whether new clothes are added to the clothes treating apparatus 100 (S304).

Specifically, when a user input is not applied during the elapse of the predetermined time interval, the controller 180 may determine whether or not clothes are added to the accommodation space.

In one embodiment, the controller 180 may drive the motor 230 of the moving hanger 50 for a preset time interval when a user input is not applied while a predetermined time interval elapses. While the motor 230 is driven, the controller 180 may detect information related to a weight of clothes caught on the moving hanger based on a power value consumed by the motor 230. In addition, the controller 180 may determine whether or not clothes have been added into the accommodation space based on the detected weight.

In another embodiment, when a user input is not applied while a predetermined time interval elapses, the controller 180 may determine whether or not clothes have been added into the accommodation space based on a sensing value of the optical sensor provided on the moving hanger 50.

More specifically, when any one of the plurality of light receiving portions included in the plurality of optical sensors is blocked from receiving light, the controller 180 may determine that a coat hanger with new clothes caught have been hung on the hanger groove corresponding to the light-blocked light receiving portion.

In another embodiment, when a user input is not applied while a predetermined time interval elapses, the controller 180 may determine whether or not clothes have been added into the accommodation space, based on the sensing value of the weight sensor 301 installed in the hanger bar 250 of the moving hanger 50.

On the other hand, the controller 180 may determine whether or not clothes have been added into the accommodation space, by simultaneously using various types of sensors corresponding to the various aforementioned methods.

When it is determined that new clothes have been added into the clothes treating apparatus 100, the controller 180 may perform a steam emitting function to supply steam into the clothes treating apparatus 100 (S305).

In one embodiment, the controller 180 may adjust an amount of steam to be emitted, a time for emitting the steam, or a moisture content in the steam, on the basis of preset setting information. The preset setting information may be changed by a user input.

The controller 180 may then perform a drying stroke to remove internal moisture of the accommodation space 20 of the clothes treating apparatus 100 by supplying dry air into the accommodation space 20 (S306).

In detail, the controller 180 may control at least one of the air supply device 30, the heater, and the heat pump to supply dry air into the accommodation space. That is, the controller 180 may supply heated air into the accommodation space by controlling at least one of the air supply device 30, the heater, and the heat pump.

Similarly, the controller 180 may adjust a time for performing the drying stroke and a temperature of the heated air, based on preset setting information.

According to the clothes treating apparatus as described above, when new clothes are introduced into the clothes treating apparatus, a dust removing function or a deodorization function is performed with respect to the introduced clothes even if any user input is not applied. This results in obtaining an effect of keeping the clothes cleaner.

Also, according to the present invention, cross contamination between newly introduced clothes and previously stored clothes in the clothes treating apparatus can be prevented.

In addition, according to the present invention, the user of the clothes treating apparatus can surely keep newly-stored clothes and previously stored clothes clean, even without a separate input when keeping the new clothes in the clothes treating apparatus.

Hereinafter, an example of a user interface output on a display of the clothes treating apparatus of the present invention will be described with reference to FIG. 4.

Figure 4:
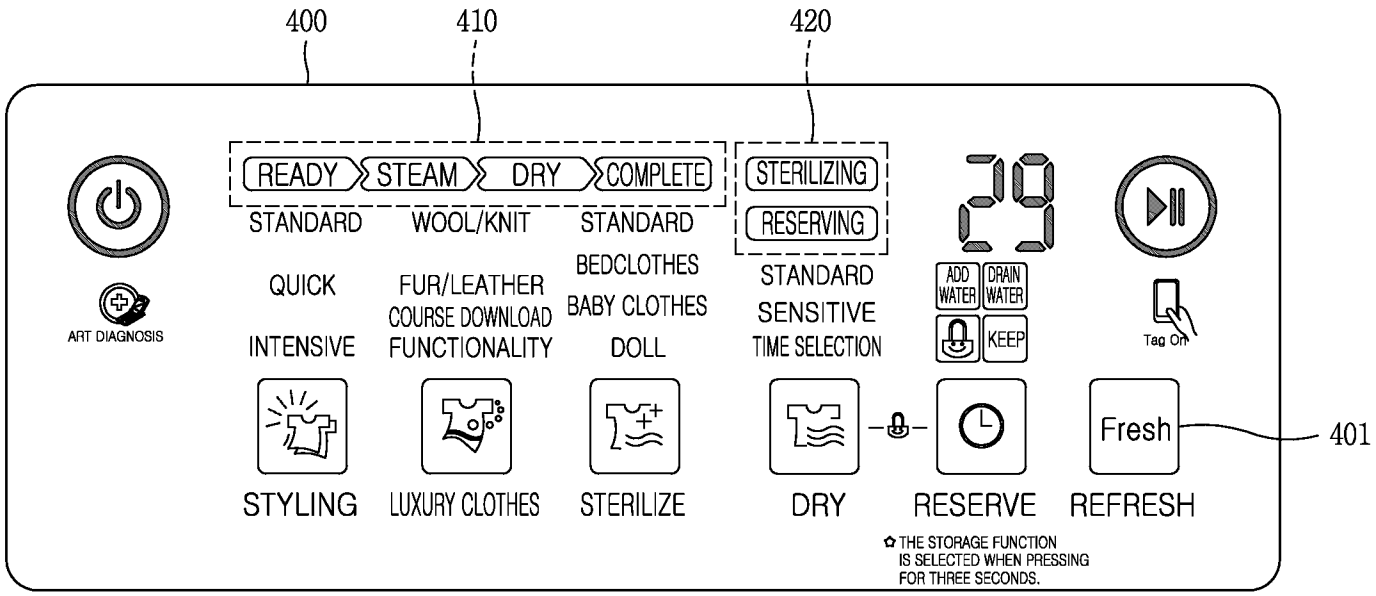
FIG. 4 is a conceptual view illustrating one embodiment related to a display of a clothes treating apparatus while a method for controlling a clothes treating apparatus according to the present invention is executed.

As illustrated in FIG. 4, a display 400 of the clothes treating apparatus 100 is configured to output a button 401 for activating one mode of the clothes treating apparatus 100, which performs a preset operation for newly-introduced clothes, even when a user input is not applied after the new clothes are introduced into the clothes treating apparatus 100. In the present invention, the one mode is referred to as "refresh mode."

The controller 180 may activate or deactivate the refresh mode of the clothes treating apparatus 100 whenever a user input is applied to the button 401.

The display 400 of the clothes treating apparatus 100 may output a first status display window 410 and a second status display window 420. Whether or not the refresh mode is activated may be output on at least one of the first and second status display windows.

In the activated state of the refresh mode, when a user input is not applied to the input unit while a predetermined time interval elapses from a time point that the door has been opened and then closed, the controller 180 may determine whether clothes have been added into the accommodation space. When it is determined that the clothes have been added into the accommodation space, the controller 180 may perform a preset operation of the clothes treating apparatus.

On the other hand, when the refresh mode is in an deactivated state, the controller 180 may operate the clothes treating apparatus according to a user input applied to the input unit. The controller 180 may control the clothes treating apparatus to enter a standby state when any user input is not applied.

According to the present invention, when new clothes are introduced into the clothes treating apparatus, a dust removing function or deodorization function can be performed with respect to the introduced clothes even without an any input applied by the user. This results in obtaining an effect of keeping such clothes cleaner.

Further, according to the present invention, cross contamination between newly introduced clothes and previously stored clothes in the clothes treating apparatus can be prevented.

In addition, according to the present invention, the user of the clothes treating apparatus can surely keep newly-stored clothes and previously stored clothes clean, even without a separate input when keeping the new clothes in the clothes treating apparatus.

What is claimed is:

1. A clothes treating apparatus, comprising;
- a door allowing access to an opening in an accommodation space of the clothes treating apparatus;
- a hanger provided in the accommodation space, the hanger configured to have clothes caught thereon;
- a sensing unit configured to sense information related to clothes placed in the clothes treating apparatus;
- a controller configured to control an operation of the clothes treating apparatus based on the sensed information; and
- an input unit configured to receive user input associated with the operation of the clothes treating apparatus,
- wherein the controller is further configured to determine:
  - whether the user input is applied to the input unit during a first time interval from a time point that the door has been opened and then closed, and
  - whether clothes have been added into the accommodation space if no user input is applied during the first time interval, and
- wherein the controller is configured to perform a preset operation of the clothes treating apparatus when it is determined that clothes have been added to the accommodation space.

2. The apparatus of claim 1, wherein the hanger comprises:
- a motor configured to apply motion to clothes caught on the hanger,
- wherein the controller is configured to drive the motor when the door is opened and then closed.

3. The apparatus of claim 2, wherein the controller is further configured to:
- drive the motor for a second time interval when the door is opened and then closed,
- detect information related to a weight of clothes caught on the hanger based on a power value consumed by the motor while the motor is driven, and
- determine whether or not clothes have been added into the accommodation space based on the detected weight.

4. The apparatus of claim 1, wherein the sensing unit is further configured to sense information related to clothes caught on the hanger.

5. The apparatus of claim 4, wherein the sensing unit comprises:
- a weight sensor configured to sense a weight of clothes caught on the hanger,
- wherein the controller is configured to determine whether or not clothes have been added into the accommodation space based on a sensing value of the weight sensor.

6. The apparatus of claim 4, wherein the sensing unit comprises:
- an optical sensor provided with a light emitting portion and a light receiving portion, and
- wherein the controller is configured to determine whether or not clothes have been added into the accommodation space based on a sensing value of the optical sensor.

7. The apparatus of claim 1, wherein the preset operation of the clothes treating apparatus is to emit steam into the accommodation space for a third time interval.

8. The apparatus of claim 1, wherein the preset operation of the clothes treating apparatus is to supply heated air into the accommodation space for a third time interval.

9. The apparatus of claim 1, wherein the preset operation of the clothes treating apparatus is to vibrate the hanger for a third time interval.

10. The apparatus of claim 1, wherein the preset operation of the clothes treating apparatus is to perform at least one of a process of emitting steam, a process of supplying heated air, and a process of vibrating the hanger, in an arbitrary sequence.

11. The apparatus of claim 1, wherein the controller is configured to perform the operation of the clothes treating apparatus based on the user input applied during the first time interval.

12. The apparatus of claim 1, wherein the controller is configured to stop the preset operation and perform the operation of the clothes treating apparatus based on the applied user input when the user input associated with the operation of the clothes treating apparatus is applied to the input unit while the preset operation of the clothes treating apparatus is performed.

13. A clothes treating apparatus, comprising;

a door allowing access to an opening in an accommodation space of the clothes treating apparatus;

a hanger provided in the accommodation space, the hanger configured to have clothes caught thereon;

a sensing unit configured to sense information related to clothes placed in the clothes treating apparatus;

a controller configured to control an operation of the clothes treating apparatus based on the sensed information; and an input unit configured to receive user input associated with the operation of the clothes treating apparatus, wherein the controller is further configured to determine:

whether the user input is applied to the input unit during a first time interval from a time point that the door has been opened and then closed, and whether clothes have been added into the accommodation space if no user input is applied during the first time interval, wherein the controller is configured to perform a preset operation of the clothes treating apparatus when it is determined that clothes have been added to the accommodation space, and wherein the preset operation of the clothes treating apparatus is to emit steam or to supply heated air into the accommodation space for a third time interval.

* * * * *